United States Patent [19]

Bennett

[11] 4,116,423

[45] Sep. 26, 1978

[54] APPARATUS AND METHOD TO FORM METAL CONTAINING NONDENDRITIC PRIMARY SOLIDS

[75] Inventor: Foster C. Bennett, Columbus, Ohio

[73] Assignee: Rheocast Corporation, Germantown, Wis.

[21] Appl. No.: 799,429

[22] Filed: May 23, 1977

[51] Int. Cl.[2] ..... C22B 45/00

[52] U.S. Cl. ..... 266/200; 266/235; 75/65 R; 75/67 R

[58] Field of Search ..... 266/200, 235; 164/71, 164/82; 75/63, 65 R, 135, 67 R

[56] References Cited

U.S. PATENT DOCUMENTS

| | | | |
|---|---|---|---|
| 1,526,851 | 2/1925 | Hall | 266/235 |
| 3,902,544 | 9/1975 | Flemings et al. | 164/71 |

*Primary Examiner*—Gerald A. Dost

*Attorney, Agent, or Firm*—Kenway & Jenney

[57] ABSTRACT

An apparatus and method to form a metal containing degenerate dendrites are disclosed. Molten metal is cooled in a receiving means and agitated by rotating blades connected to a rotating shaft. Solid metal, such as dendrites, deposited on inner wall portions of the receiving means are removed by suitable means, such as a scraping blade, in operable combination with the rotating blades. The so produced metal can be cast by conventional metal casting processes.

4 Claims, 2 Drawing Figures

APPARATUS AND METHOD TO FORM METAL CONTAINING NONDENDRITIC PRIMARY SOLIDS

BACKGROUND OF THE INVENTION

This invention relates to the treatment of molten metal and more in particular to an apparatus and method adapted to treat molten metals to form a metal composition containing nondendritic primary solids.

It has been determined that molten metal containing up to about 65 weight percent solids comprising degenerate dendrites exhibits thixotropic properties. The preparation of metal compositions containing such degenerate dendrites is described in, for example, U.S. Pat. Nos. 3,902,544, issued Sept. 2, 1975, and 3,936,298, issued Feb. 3, 1976. As molten metal is cooled dendrites can be formed. The solidifying metal is vigorously agitated to prevent the formation of interconnected dendritic networks and to substantially eliminate or reduce dendritic branches already formed. The apparatus of U.S. Pat. Nos. 3,902,544 and 3,936,298 have been found useful in preparing the desired metal.

It is an object of the invention to provide an improved means to form metal containing degenerate dendrites.

It is another object of the invention to provide an improved method to form metal containing degenerate dendrites.

SUMMARY OF THE INVENTION

The apparatus of the present invention is suited to form metal containing degenerate dendrites. This apparatus comprises in combination a means to contain a molten metal with an inlet suitable to feed metal and an outlet suitable to discharge the molten metal, a means to receive the molten metal from the containing means and to contain the molten metal during agitation and cooling of the molten metal. A means is in combination with the metal receiving means to control the temperature of the molten metal.

A rotatable means is generally axially positioned within the receiving means. The rotatable means has a rotatable support with spaced apart molten metal agitating blades attached to the support and extending in a generally outwardly direction therefrom toward an inner wall portion of the receiving means. The agitating means are spaced apart from said inner wall portion during rotation of the rotatable means.

A means to remove solid metal deposited on said inner wall portion from metal contained in the receiving means is in operable combination with the agitating means.

In the method of the present invention the temperature of the molten metal in the receiving means is controlled to between the liquidus and the solidus temperatures of the metal, and the molten metal is agitated sufficiently to minimize formation of interconnected dendrites. During agitation, any metal deposited on the inner wall portions of the metal receiving means is continuously removed to minimize accumulation of solid metal deposited on such wall portions. The so-treated metal is solidified by well-known methods.

BRIEF DESCRIPTION OF THE DRAWING

The accompanying drawing further illustrates the invention.

DESCRIPTION OF THE PREFERRED EMBODIMENTS

Figure 1:
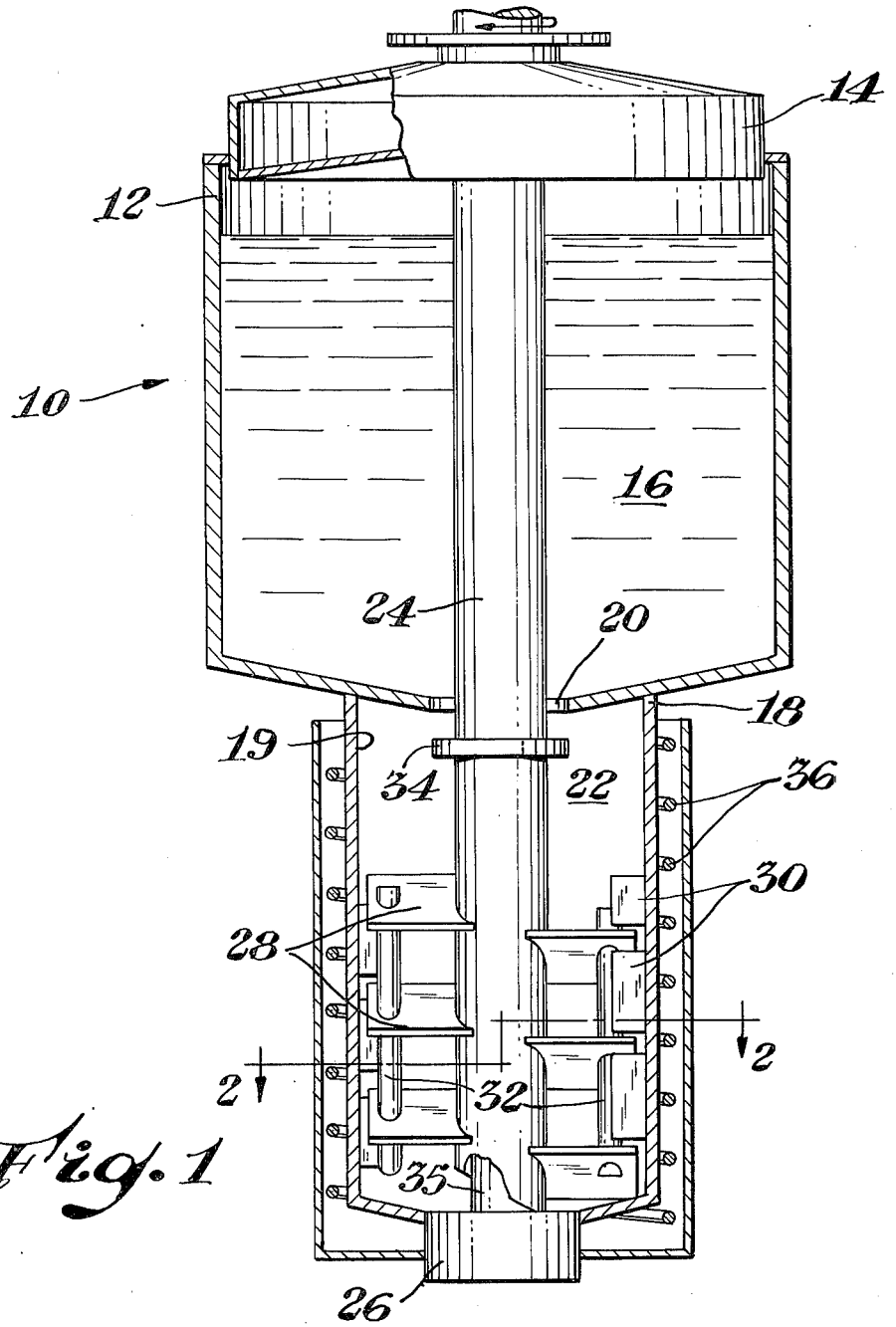
In FIG. 1 is depicted a cross sectional view of one embodiment of the metal treating apparatus of the invention; and In FIG. 2 is a cross sectional view of the apparatus of FIG. 1 taken across plane 2—2.
Figure 2:
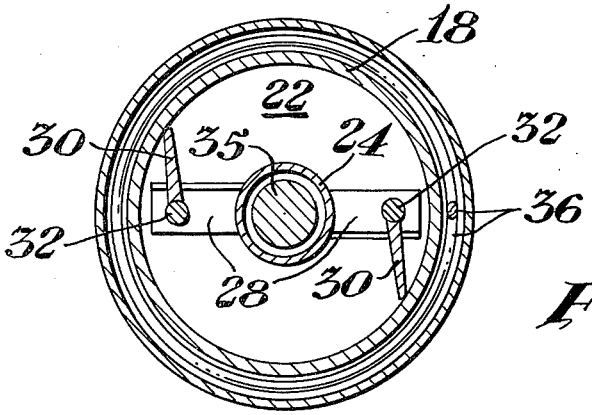

Referring now to FIGS. 1 and 2 of the drawing, there is shown a molten metal treating apparatus 10. The treating apparatus 10 includes a means 12 to contain the molten metal. The containing means 12 can be a suitable container resistant to the molten metal. Those skilled in the art are familiar with the specific materials of construction to use for such metal holding or containing means and for all other portions of the apparatus. For example, steel, ceramic and graphite have been employed for use with various molten metals.

The containing means has an inlet to permit charging of solid and, preferably, molten metal. In FIG. 1, this inlet is sealed with a cover means 14 to minimize heat loss from the containing means 12 and to assist in reducing oxidation of molten metal 16 in the containing means 12.

A molten metal receiving means 18 with generally cylindrically shaped interior wall portions 19 is suitably attached to the containing means 12 to permit molten metal to flow from within the containing means 12 through an outlet 20 and into an agitation chamber 22 within the metal receiving means 18. A rotatable means, such as an elongated support or shaft 24, is positioned to extend through the cover means 14, the containing means 12 and the outlet 20 into a generally axial relationship with the interior wall portions 19 of the metal receiving means. A lower end portion of the shaft 24 sealably extends into an outlet 26 suitable to discharge metal from the receiving means 18. The shaft 24 has a plurality of agitating means, such as blades 28, connected thereto and extending in an outwardly, and preferably a generally radial direction, from the shaft 24 toward the wall portions 19. The blades 28 are spaced apart from the wall portions 19 to avoid contact and possible jamming or wear during operation. Two sets of blades 28 on generally opposite wall portions of the shaft 24 are preferably substantially equal in weight to permit more uniform, i.e., minimum vibration, rotation of the shaft 24. The total weight of the blades 28 and a metal removal means, including shearing plates 30 and pivoting means 32 should also be considered when positioning the blades 28, shearing plates 30 and pivoting means 32 in a weight balanced array around the shaft 24. The blades 28 in FIG. 1 are positioned at about a 30 degree angle from horizontal to provide a shearing type stirring motion during rotation of the shaft 24. Other angles for the blade position and cross sectional configurations of the blade are satisfactory so long as a sufficient stirring motion is imparted to the molten metal to break apart the dendrites which form upon cooling of the molten metal.

The shearing plates 30 are adapted to move outwardly from the shaft 24 and contact the wall portions 19 during rotation of the shaft in a clockwise direction. In the Drawing such outward movement is effected by centrifugal force pulling the shearing plates 30 against the wall portions 19 to scrape or shear off deposited solid metal, such as dendrites, which have deposited on such wall portions during cooling of the molten metal. Clearly, pivoting means 32 can be of other configurations, such as hinges. Likewise, means to retain the shearing plates 30 in a preferred substantially constant contact with the wall portion 19 in combination with, or in lieu of, centrifugal force are within the scope of this invention.

A single, elongated shearing plate (not shown) can be employed instead of the shorter shearing plates 30. Also, the specific location, and number, of the blades 28 and the shearing plates 30 positioned around the shaft 24 can vary; however, it is preferred that the combined shaft, blades, pivots and shearing plates be axially balanced to minimize vibration during operation.

If desired, the shearing plates 30 or the blades 28 can be provided with a suitable means or extension (not shown) to minimize the possibility that such plates might rotate toward the shaft 24 before rotation thereof has started and not contact the wall portion 19 when the shaft rotates.

Operation of the metal treating apparatus 10 is carried out in a similar manner to that described in U.S. Pat. No. 3,902,544, which, for brevity, is incorporated herein by reference. Metals suitable for treatment with the herein described apparatus are, for example, aluminum, copper, iron, nickel cobalt, lead, zinc and, preferably magnesium, and alloys thereof. Hereinafter, the description will refer to the preferred metal, magnesium and alloys thereof; however, it is to be understood that such description is equally applicable to other metals (including alloys).

A magnesium alloy, such as a commercially available magnesium-aluminum-zinc alloy, is charged into the containing means 12 after removal of the cover 14. If the magnesium alloy is molten when charged, it is only necessary to maintain the metal at a desired temperature which is the containing means. If desired, the metal can be charged in a solid form and melted in the containing means. Suitable commercially available heating means (not shown) can be used for the desired heating and/or melting. The shaft 24 includes a metal baffel means 34. During operation the baffel means 34 reduces the movement of metal between the containing means 12 and the agitation chamber 22 and aids in more accurately controlling the metal temperature.

In a preferred embodiment, the shaft 24 is tubular and has a metal outlet plug 35 generally axially positioned therein. The outlet plug 35 extends through the center portion of the preferred tubular shaft 24 and is adapted to operate independently of the shaft 24.

The plug 35 is moved downwardly to seal the outlet 26 and permit filling of the agitation chamber 22 with molten metal. The temperature of the metal in such chamber is controlled by suitable heating and/or cooling means 36. The metal is cooled to permit a portion of the metal to freeze. During such freezing the molten magnesium is agitated by rotating the shaft 24 at a sufficient rate to minimize, and preferably, prevent the formation of interconnected solid dendrites in the molten magnesium. The shearing plates 30 continuously remove metal deposited on the inner wall portion 19 to minimize accumulation of solid magnesium deposited on such wall portions. The use of the shearing plates 30 in combination with the blades 28 increases heat transfer between the heating and cooling means 36 and the molten magnesium in the agitation chamber 22, agitation or mixing of the molten metal, reduces the formation interconnected dendrites and aids in forming the desired degenerate, or broken dendrites substantially uniformly distributed throughout the metal in the agitation chamber 22.

When the desired concentration of solids in the molten magnesium has been reached, the shaft is raised to open the outlet 26 to remove the metal from the agitation chamber 22. Continued rotation of the shaft 24 assists in removing metal from the agitation chamber 22. The liquid-solid mixture produced can be cast by well-known means into desired shapes.

If desired, solid metallic and/or nonmetallic substances can be mixed into the molten metal in the agitation chamber 22.

The following example further illustrates the invention:

EXAMPLE

A metal treating apparatus substantially is the same as that shown in the Drawing was employed for this Example. A standard magnesium base alloy (AZ91B) with a nominal composition of 9 weight percent aluminum, 0.7 weight percent zinc, 0.2 weight percent manganese and the balance essentially magnesium was melted in a melting container separate from the metal treating apparatus. About 20 pounds of the molten magnesium alloy was transferred to the containing means and agitation chamber of the metal treating apparatus. An argon atmosphere was maintained within the apparatus to prevent the magnesium alloy from burning. The molten metal temperature of the metal charged into such apparatus was approximately 615° C.

Initially, the metal contained within the agitation chamber was heated by heating coils positioned around the exterior periphery of the agitation chamber. The agitating means, including the shaft, agitating or mixing blades and shearing plates, was a total of approximately 4 inches in diameter. When this agitation means was rotated at about 300 revolutions per minute, the heat applied by the coils was turned off and the metal within the agitation chamber cooled by passing air through three tubular coils surrounding the periphery of the agitating chamber. This resulted in the molten magnesium alloy being concurrently cooled and sheared.

The metal within the agitation chamber was maintained at 580° C. during agitation. At this temperature, which is below the liquidus temperature of AZ91B alloy, the solid portion of the metal being rapidly mixed constitutes about 27 weight percent of the metal contained within the agitation chamber. The agitation provided by the apparatus employed in this example was sufficient to break apart interconnecting dendrites and minimize the formation of an interconnected dendrite structure. The shearing blades continuously scraping on the inner wall portion of the agitation chamber minimized the accumulation of solid metal deposits on the interior wall portions of the agitation chamber, even though heat was being removed through such wall portions by means of the cooling coils.

A substantially uniformly mixed or homogenous mixture of the solid and liquid metal produced at the 580° C. temperature was removed from the agitation chamber through an opening in the lower portion of such chamber by raising an axially positioned, metal outlet plug and continuing to rotate the shaft and plug to assist in removing metal from such opening. When approximately 0.66 pounds was withdrawn from the chamber, the metal outlet plug was repositioned to seal such outlet and prevent leakage of molten metal thereform. Approximately 0.66 pound of molten metal was automatically transferred from the containing means into the agitation chamber. The metal temperature within the agitating chamber increased 1° to 2° C. when the molten metal was charged thereto since the metal within the upwardly positioned containing means was maintained at 610° to 620° C. It took about an average of 0.6 minute for the temperature within the agitation chamber to be cooled to the original 580° C. by the cooling coils.

The above procedure was repeated until the desired amount of product was produced. To maintain the molten metal temperature within the upper containing means substantially uniform, molten metal was poured through the hole in the cover after about 4 pounds of product had been obtained.

The product removed from the agitation chamber was satisfactorily solidified by pressure die casting into parts of a desired configuration. The solid-liquid metal produced by this process was found to have thixotropic properties.

As is apparent from the foregoing specification, the device of the present invention is susceptible of being embodied with various alterations and modifications, which may differ from those described in the preceding description. For this reason it is to be fully understood that all of the foregoing is intended to be illustrative and not to be construed or interpreted as being restrictive or otherwise limiting the present invention.

What is claimed is:

1. An apparatus to form metal containing degenerate dendrites comprising:

a means to contain a molten metal with an inlet suitable to feed metal and an outlet suitable to discharge the molten metal;

a means to receive the molten metal from said containing means; and to contain the molten metal during agitation and cooling of the molten metal;

a means in combination with said metal receiving means to control the temperature of the molten metal;

a rotatable means generally axially positioned within said metal receiving means, said rotatable means having a rotatable support with spaced apart molten metal agitating means attached to the support and extending in a generally outwardly direction therefrom toward an inner wall portion of said metal receiving means, the agitating means being spaced apart from the inner wall portion;

a means to remove solid metal deposited on the inner wall portion of said metal receiving means in operable combination with the agitating means;

said metal removal means being pivotably attached to the agitating means.

2. The apparatus of claim 1 wherein said metal removal means is adapted to rotate sufficiently to contact the inner wall portions of said receiving means during rotation of the rotatable support.

3. The apparatus of claim 2 wherein the inner wall portions of said receiving means are generally cylindrical in configuration.

4. The apparatus of claim 3 wherein the agitating means are positioned in a weight balanced array around the rotatable support and said metal removal means is adapted to move outwardly by centrifugal force to contact the inner wall portions.

* * * * *